US010472901B2

(12) United States Patent
Engel et al.

(10) Patent No.: US 10,472,901 B2
(45) Date of Patent: Nov. 12, 2019

(54) ELECTRICAL WELLBORE INSTRUMENT SWIVEL CONNECTOR

(71) Applicant: Schlumberger Technology Corporation, Sugar Land, TX (US)

(72) Inventors: David Engel, Houston, TX (US); April Bohannan, Sugar Land, TX (US); William Rohr, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 365 days.

(21) Appl. No.: 15/382,881

(22) Filed: Dec. 19, 2016

(65) Prior Publication Data

US 2018/0175545 A1 Jun. 21, 2018

(51) Int. Cl.

| | |
|---|---|
| ***E21B 17/05*** | (2006.01) |
| ***E21B 17/02*** | (2006.01) |
| *H01R 13/52* | (2006.01) |
| *H01R 13/502* | (2006.01) |
| *H01R 13/622* | (2006.01) |

(52) U.S. Cl.

CPC ..... *E21B 17/05* (2013.01); *E21B 17/026* (2013.01); *E21B 17/028* (2013.01); *H01R 13/502* (2013.01); *H01R 13/5202* (2013.01); *H01R 13/622* (2013.01)

(58) Field of Classification Search

CPC ..... E21B 17/05; E21B 17/028; E21B 17/026

See application file for complete search history.

(56) References Cited

U.S. PATENT DOCUMENTS

2015/0340803 A1* 11/2015 Li ..... H01R 13/4538 439/141

* cited by examiner

*Primary Examiner* — Kristyn A Hall
(74) *Attorney, Agent, or Firm* — Eileen Pape

(57) ABSTRACT

An electrical instrument swivel connector has a first housing part and a second housing part rotatably connected to each other. The connection enabling transfer of axial loading between the housing parts. A first insulator body is rotatably engaged with a second insulator body and respectively sealingly engageable with an interior surface of the first housing part and the second housing part. Electrical contact pins are formed into the first insulator body and the second insulator body. The electrical contact pins each terminate in a separate electrical contact wherein the first insulator body rotatably engages the second insulator body. A biased electrical contact is disposed between each respective separate electrical contact in the first insulator body and the second insulator body.

20 Claims, 5 Drawing Sheets

ELECTRICAL WELLBORE INSTRUMENT SWIVEL CONNECTOR

CROSS REFERENCE TO RELATED APPLICATIONS

Not Applicable.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of well logging instruments conveyed by cable into and along the interior of a subsurface wellbore. More specifically, the disclosure relates to between-instrument couplers that include the capability of free and unlimited rotation of instruments attached to one side of the coupler while maintaining full electrical connection between such instrument and any components attached to the other side of the coupler.

Wireline electrical logging includes extending at least one electrically operated instrument into a wellbore at the end of an armored electrical cable. The armored electrical cable comprises at least one insulated electrical conductor and is covered on its exterior with one or more layers of helically wound armor wire. The armor wire layer(s) provide(s) tensile strength, bend resistance and abrasion resistance to the cable, among other functions. Because of the helical wind on many types of armored electrical cable used in well logging and other types of well intervention servicing, when the electrical cable undergoes changes in axial loading, the helical windings exert a torque as a result of unwinding caused by the axial loading. Such torque may hinder operation of some types of well logging instruments which may function better when the instrument is not subject to rotation in the wellbore resulting from the cable torque.

SUMMARY

An electrical instrument swivel connector according to one aspect of the disclosure has a first housing part and a second housing part rotatably connected to each other. The connection enabling transfer of axial loading between the housing parts. A first insulator body is rotatably engaged with a second insulator body and respectively sealingly engageable with an interior surface of the first housing part and the second housing part. Electrical contact pins are formed into the first insulator body and the second insulator body. The electrical contact pins each terminate in a separate electrical contact wherein the first insulator body rotatably engages the second insulator body. A biased electrical contact is disposed between each respective separate electrical contact in the first insulator body and the second insulator body.

A method for well logging according to another aspect of the disclosure comprises moving at least one well logging instrument along a wellbore by extending or retracting an electrical cable. Torque in the cable caused by the extending or retracting is relieved by coupling the well logging instrument to the cable or to another well logging instrument using a swivel according to the above described aspect of the disclosure.

Other aspects and advantages will be apparent from the description and claims that follow.

DETAILED DESCRIPTION

Figure 1:
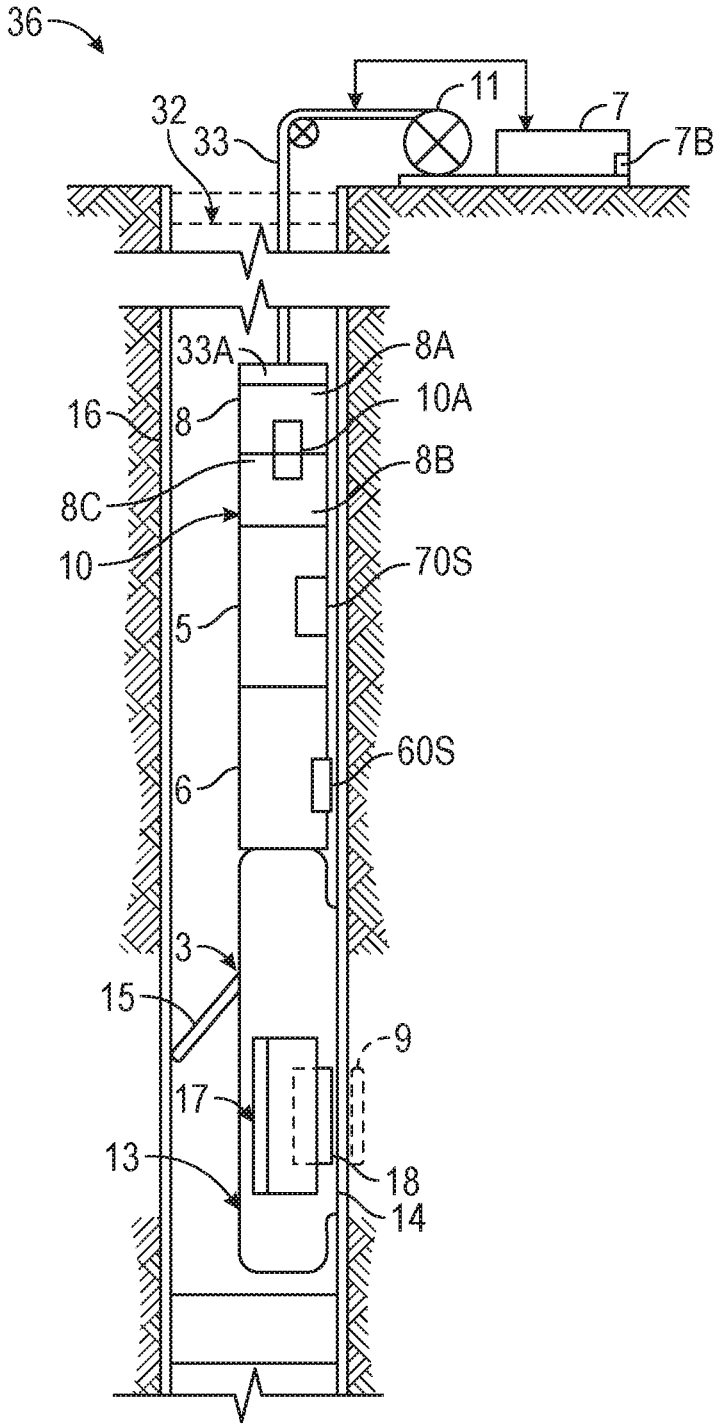
FIG. 1 shows an example of well log data acquisition using a wireline conveyed instrument string.

FIG. 1 shows an example manner in which well construction related data, e.g., well log data may be acquired by "wireline", wherein an assembly or "string" of well logging instruments (including sensors or "sondes" 5, 6 and 3 as will be further explained) is lowered into a wellbore 32 drilled through the subsurface 36 at one end of an armored electrical cable 33. The armored electrical cable 33 is extended into and withdrawn from the wellbore 32 by means of a winch 11 or similar conveyance known in the art. The armored cable 33 may transmit electrical power to the instruments 5, 6, 3 in the instrument string, and may communicate signals corresponding to measurements made by sensors in the instruments 5, 6, 3 in the string to a recording unit 7 at the earth's surface. The recording unit 7 may include a device (not shown) to measure the extended length of the cable 33. Depth of the instruments 5, 6, 3 within the wellbore 32 is inferred from the extended cable length. The recording unit 7 may include equipment (not shown separately) of types well known in the art for making a record with respect to depth or time of the instruments (sensors) 5, 6, 3 within the wellbore 32.

The instruments 5, 6 and 3 may be of any type well known in the art for purposes of the defining the scope of the present disclosure. These comprise, without limitation, gamma ray sensors, neutron porosity sensors, electromagnetic induction resistivity sensors, nuclear magnetic resonance sensors, and gamma-gamma (bulk) density sensors. Some sensors such as 70S, 60S are contained in a sonde "mandrel" (axially elongated cylinder) which may operate effectively near the center of the wellbore 32 or displaced toward the side of the wellbore 32. Others sensors, such as a density sensor 3, include a sensor pad 17 disposed to one side of the sensor housing 13 and have one or more detecting devices 14 therein. In some types of well logging instruments the sensor 3 includes a radiation source 18 to activate the formations 36 proximate the wellbore 32. Such sensors are typically responsive to a selected zone 9 to one side of the wellbore 32. The sensor 3 may also include a caliper arm 15 which serves both to displace the sensor 3 laterally to the side of the wellbore 32 and to measure an apparent internal diameter of the wellbore 32.

The instruments 5, 6 and 3 may be connected to the cable 33 using a cable head 33A. The cable head 33A has features (not shown separately) for making mechanical and electrical (and/or optical) connection between the cable 33 and the instruments 5, 6, 3.

In the present example embodiment, an electrical and mechanical swivel 10 may be disposed between the cable head 33A and the uppermost well logging instrument, shown at 5 in FIG. 1. The electrical and mechanical swivel 10 may include a two-part housing, wherein the housing parts are rotatably coupled to each other and are able to support axial tension. The housing parts are shown at 8A and 8B. The housing parts may have the capability of transferring axial loading between the housing parts 8A, 8B using any suitable rotational coupling 8C. The rotational coupling 8C may comprise, for example an axial thrust bearing (not shown in FIG. 1), and a retainer (not shown in FIG. 1) to hold the housing parts 8A, 8B together, to transfer axial load between the parts 8A, 8B and to exclude fluid from the wellbore 32 from entering the interior of the swivel 10.

The electrical and mechanical swivel 10 may include an electrical swivel coupling 10A disposed inside the housing parts 8A and 8B. The electrical swivel coupling 10A is arranged to enable full, unrestricted rotation between the housing parts 8A, 8B while maintaining electrical continuity between electrical conductors (see FIG. 2) disposed in each part of the electrical swivel coupling 10A. The electrical swivel coupling 10A also electrically insulates the electrical conductors (FIG. 2) from the fluid in the wellbore and from each other as will be further explained with reference to FIG. 2.

The instrument configuration shown in FIG. 1 is only meant to illustrate in general terms acquiring "well log" data by "wireline" and is not intended to limit the scope of the present disclosure as to the manner in which data are acquired at a wellsite or the type of data applicable to a system and method as will be further explained herein.

Figure 2:
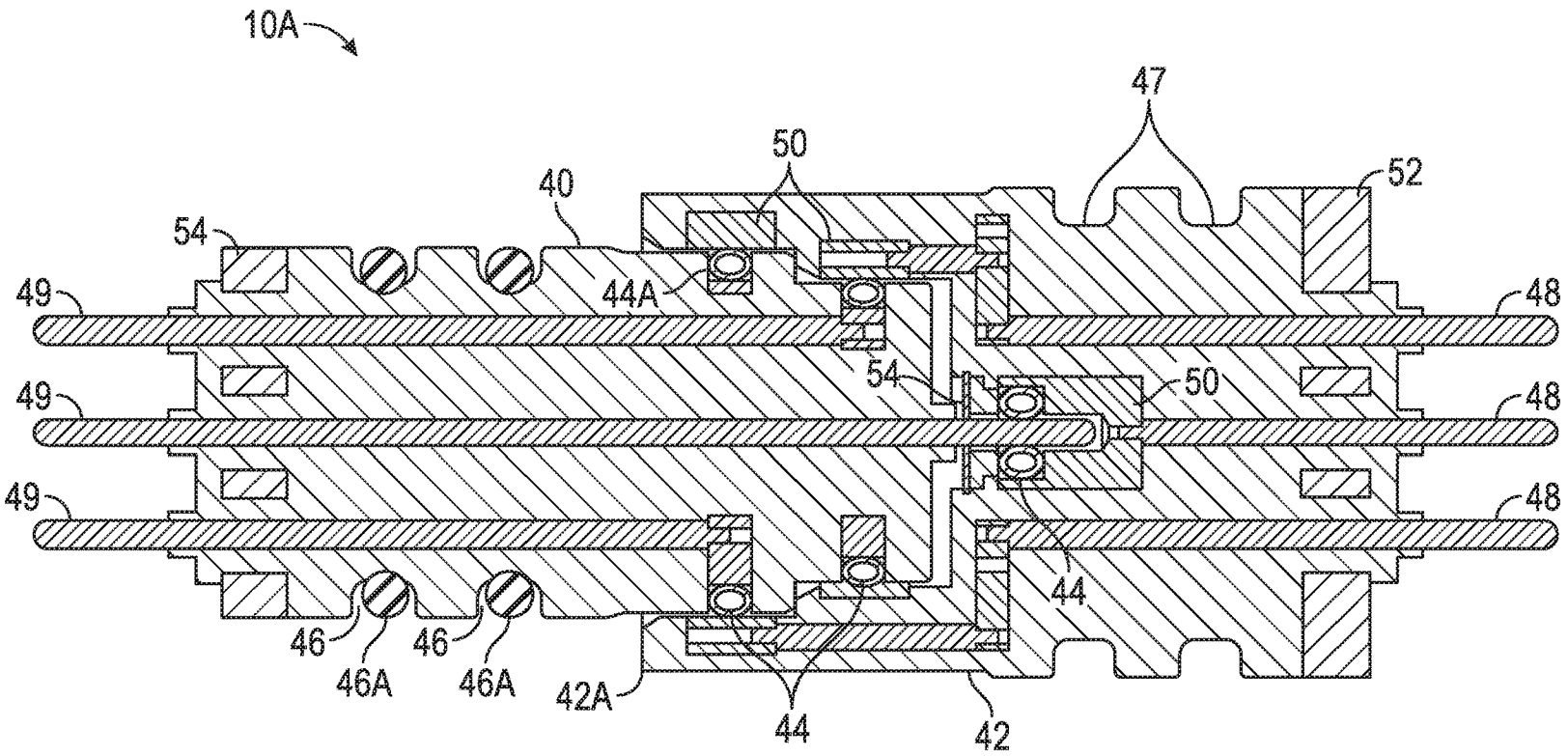
FIG. 2 shows an example electrical contact swivel that may be used to couple some instruments to others or connected directly to a cable as shown in FIG. 1.

An example embodiment of an electrical swivel coupling 10A is shown in more detail in FIG. 2. The electrical swivel coupling 10A may include a first insulator body 40. The first insulator body 40 may be made from electrically insulating, pressure and temperature resistant material such as polyether ether ketone (PEEK) or poly ether ketone (PEK). One or more electrical contact pins 49 which extend along the longitudinal dimension of the first insulator body 40 may be molded into the first insulator body 40 so as to form a pressure-tight seal between the electrical contact pins 49 and the first insulator body 40.

The first insulator body 40 may have molded into its exterior surface one or more grooves 46 for insertion into each such groove an o-ring 46A or similar fluid pressure barrier. The o-ring(s) 46A may make contact with an inner surface of one of the housing parts (e.g., 8B in FIG. 1) so as to exclude fluid under pressure from bypassing the exterior of the first insulator body 40 and thus entering the electrical and mechanical swivel (10 in FIG. 1).

The electrical contact pins 49 may terminate beyond a longitudinal end of the first insulator body 40 to enable electrical contact with mating components (e.g., electrical sockets) in one of the instruments connected to a housing part (e.g., 8B in FIG. 1). The opposite longitudinal end of each electrical contact pin 49 may terminate in an electrical contact 50 such as a contact ring. The electrical contacts 50 may be longitudinally spaced apart from each other and may in some embodiments cover the entire circumference of the first insulator housing 40. In some embodiments the electrical contacts 50 may have only a small circumferential extent, or may simply be contact points for electrical contact springs 44. In the present example embodiment, the contact pins 49 may each terminate within a groove 44A. Each groove 44A may extend around the entire circumference of the first insulator body 40 and may include therein a biased electrical contact 44. In some embodiments the biased electrical contacts 44 may be canted coil springs that cover the entire circumference of the corresponding groove 44A. The electrical contacts 44 may be made from, for example and without limitation, phosphor-bronze, spring steel or any similar resilient, electrically conductive material.

In some embodiments, a second insulator body 42 may comprise an annular cylindrical portion 42A. The annular cylindrical portion 42A may comprise electrical contact rings 50 that cover the entire inner circumference of the annular cylindrical portion 42 and may be longitudinally positions so that each electrical contact ring 50 is disposed over one of the electrical contacts 44 when the first insulator housing 40 is assembled to the second insulator housing 42. A retainer 54, such as a flat washer and snap ring combination may hold the first insulator body 40 in a fixed longitudinal relationship with the second insulator body 42 while enabling free rotation therebetween. The second insulator body 42 may comprise o-ring grooves 47 for insertion therein of o-rings (not shown) or any other type of seal that when engaged with an interior surface of one of the housing parts (e.g., 8A in FIG. 1) may act to exclude fluid under pressure from entering the interior of the electrical contact swivel (10 in FIG. 1).

The second insulator body 42 may have a corresponding number of electrical contact pins 48 molded or formed therein; the second insulator body being made from material similar in physical properties to that of the first insulator body 40. Examples of such materials include, without limitation, PEK and PEEK. The electrical contact pins 48 may extend longitudinally beyond the end of the second insulator body 42 to enable corresponding electrical connection to a well logging instrument or to the cable head (33A in FIG. 1). The contact pins 48 may each be electrically connected to a corresponding electrical contact ring 50.

In the example embodiment shown in FIG. 2, one of the electrical contact rings 50 is disposed coaxially with the longitudinal axis of the first insulator body 40 and the second insulator body 42. In some embodiments, such electrical contact ring and corresponding electrical contact may be omitted.

The exposed longitudinal end of each insulator body 40, 42 may include a thrust washer 54, 52 thereon in order to provide restraint on the relative axial motion of the first and second insulator bodies 40, 42 with respect to each other when they are disposed in a respective housing part (8B, 8A in FIG. 1).

Figure 3:
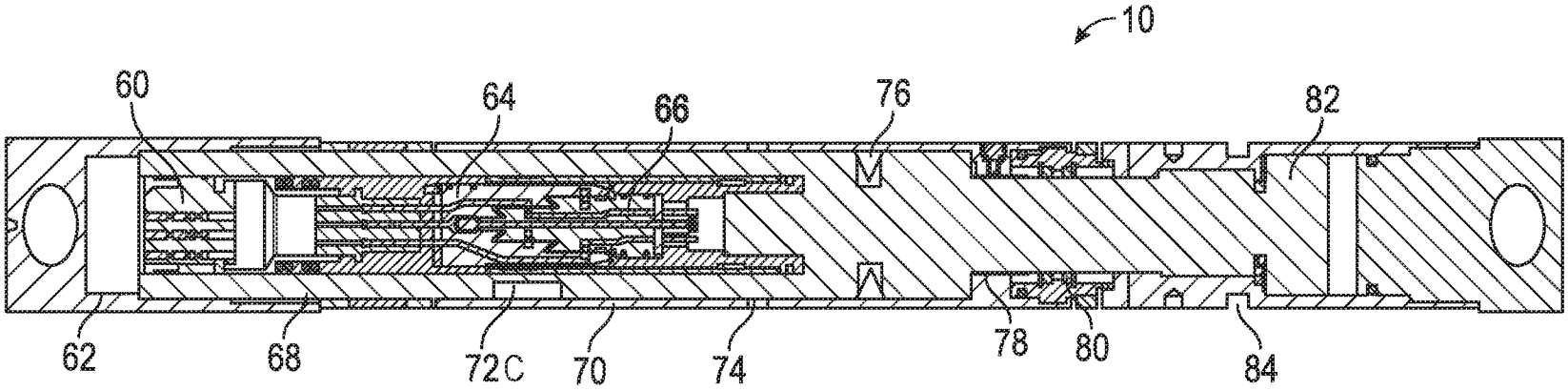
FIG. 3 shows an example embodiment of the swivel in FIG. 2 disposed in a housing as in FIG. 1.

An example embodiment of the swivel components shown in FIG. 2 disposed in a connector housing (as per FIG. 1) is shown in FIG. 3. A first connector housing 62, shown as an upper connector housing in FIG. 3 may provide mechanical and electrical connection to an adjacent component, such as a wireline logging instrument (e.g., 5 in FIG. 1) or a cable head (33A in FIG. 1). For purposes of describing the elements shown in FIG. 3, "upper" will be used to refer to the components associated with the female (second) insulator body shown at 42 in FIG. 2. "Lower" will be used to refer to the male (first) insulator body shown at 40 in FIG. 2. It is to be clearly understood that "upper" and "lower" are only intended to describe one particular example embodiment of a swivel connector according to the present disclosure. The connections between the swivel connector and adjacent components of wireline instrument(s) and/or cable head may be reversed in other embodiments with equal effect.

An upper connector assembly 60 may be sealingly engaged with an interior of the upper connector housing 62 and may have electrical contacts that engage corresponding contacts (e.g., pins 48 in FIG. 2) on the second insulator body (42 in FIG. 2). The combined insulator body and electrical contacts are shown at 64 in FIG. 3. The upper connector housing 62 may be connected, e.g., by a threaded connection, e.g., as shown at 68 to a main swivel connector housing 70. The first insulator body (40 in FIG. 2) is shown with its electrical connections disposed inside the main swivel connector housing 70 as the male swivel connector 66. The exterior of the male swivel connector 66 may be sealingly engaged to an interior of the main swivel connector housing 70. The sealing engagement of the male swivel connector 66 inside the main swivel connector housing 70 may define a chamber 72C that may be filled with dielectric liquid such as oil and compensated for exterior ambient pressure through a port 74 in the main swivel connector housing 70.

A load bearing stem 78 may be connected to the male swivel connector 66 and may be coupled to the male swivel connector so as to rotate therewith. The load bearing stem 78 may be rotatably and axially supported in the main swivel connector housing 70 by a combined axial/radial bearing 76. A lower connector 82 may make rotatable connection between the main swivel connector housing 70 and a lower connector 82. A rotary seal 80 may be disposed proximate a longitudinal end of the main swivel connector housing 70 to exclude wellbore fluid from entering the main swivel connector housing 70. A lower swivel housing 84 may be engaged with the load bearing stem 78 so as to rotate therewith and make connection to a lower connector 82. The lower connector 82 may connect to, e.g., a well logging instrument or a cable head.

Figure 4:
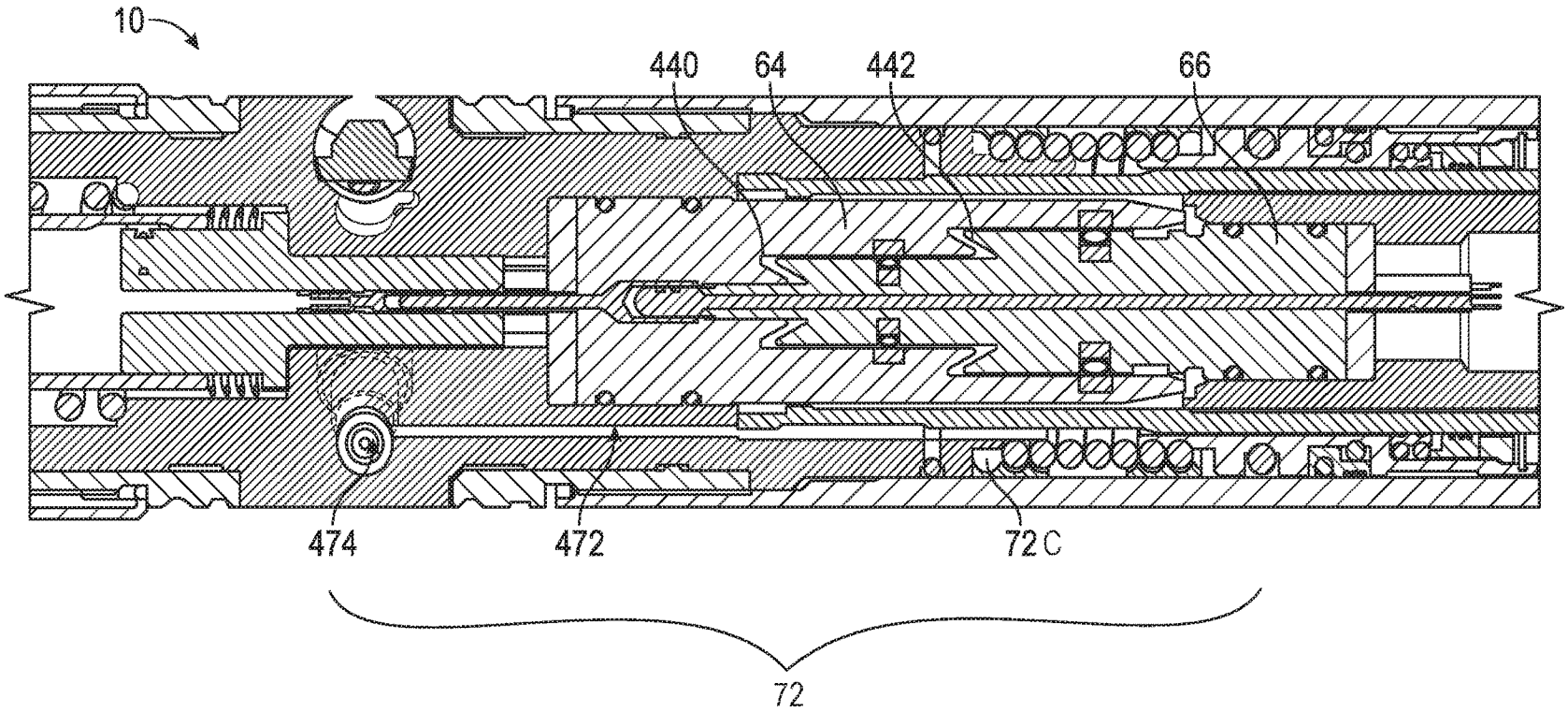
FIG. 4 depicts a detailed view of the example embodiment of FIG. 3.

FIG. 4 depicts a detailed view of the mechanical swivel 10 in the two-part housing. The main swivel connector housing 70 includes the combined upper insulator body and electrical contacts 64 and combined lower and upper insulator body 66 are located within the main swivel connector housing 70 and formed a sealed chamber therein. The pressure compensation system 72 is in communication with the sealed chamber 72C. The pressure compensation system 72 includes a fluid communication line 472 and a flow control device 474. The flow control device 474 can be any selectively actuated valve. For example, the flow control device 474 can be a pressure relief valve that opens when pressure within the sealed chamber reaches a predetermined pressure. The flow control device 474 can provide selective fluid communication between the sealed chamber and an external environment, e.g., wellbore fluids when in a wellbore.

The upper insulator body can include an upper tortuous path 440 and the lower insulator body can include a lower tortuous path 442 between the electrical contacts. The tortuous paths are from voltage potential to voltage potential; therefore, the tortuous paths increase the Creepage path.

Figure 5:
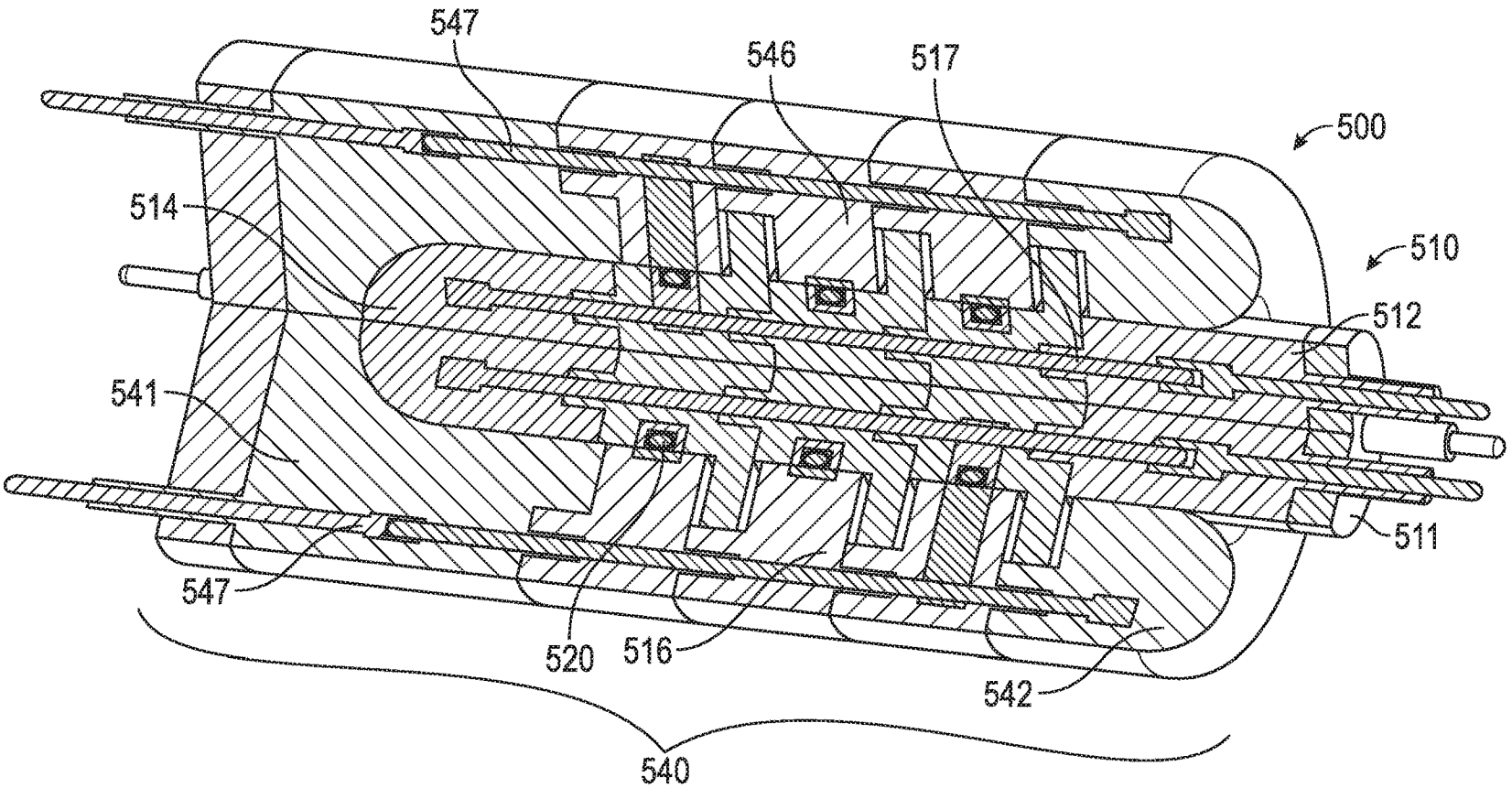
FIG. 5 depicts an embodiment of a contact swivel.

FIG. 5 depicts an embodiment of a contact swivel. The contact swivel 500 is a modular design. The contact swivel 500 includes a male portion 510. The male portion 510 can include a bulkhead component 512, an end piece 514, and one or more contact pieces 516, three are shown. The bulkhead component 512 can have a washer 511 connected therewith. The contact pieces can have one or more conductors 520. The male portion has one or more male pins 517, three are shown, that are located in the end piece 514 and run through the contact pieces 546 and connects the conductor in the body piece 516 to the pin in the bulkhead component 512 providing both mechanical support and an isolated electrical path.

The contact swivel 500 also is depicted with a female portion 540. The female portion 540 can include a female bulkhead component 541, one or more female contact pieces 546, and a female end piece 542. The female portion 540 can include one or more female pins 547, three are shown. The female pins 547 are located in the female end piece 542 and run through the female connection pieces 546 and connect with the female bulkhead component 541.

The connection pieces 516 and female connection pieces 546 can be rotated and/or selectively positioned as the contact swivel 500 is assembled to provide conductive paths between different male pins 517 and female pins 547 via conductive rings on the male body pieces 516, a canted spring 520, and conductive rings on the female body pieces 546. The conductive rings are connected to the pins on the bulkheads 541 and 512 by passing a conductive pin 547 and 517 though a conductor affixed to the conductive ring to a socket on the bulkhead pieces 512 and 541. The conductor affixed to the rings is located in a narrow radial location so several of the same piece can be used to create several independent and isolated conductive paths by rotating the piece.

Referring once again to FIG. 1, as the well logging instruments 3, 6, 5 are moved along the interior of the wellbore 32 by extending or retracting the cable 33, the cable 33 will exert torque because of the helically wound armor disposed on the exterior of the cable 33. When the cable 33 is connected to the logging instruments 3, 6, 5 through the swivel 8, the torque may be relieved without communication thereof to the logging instruments 3, 6, 5. Thus, well logging may proceed without the instruments 3, 6, 5 being urged to rotate by reason of the cable torque. Sidewall contact well logging instruments, e.g., as shown at 3 may make better wellbore wall contact along an interval of the wellbore to be measured because the instrument will not be urged out of wall contact by reason of cable torque.

Although only a few examples have been described in detail above, those skilled in the art will readily appreciate that many modifications are possible in the examples. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f), for any limitations of any of the claims herein, except for those in which the claim expressly uses the words "means for" together with an associated function.

What is claimed is:

1. An electrical instrument swivel connector, comprising:

a first housing part and a second housing part rotatably connected to each other, the connection enabling transfer of axial loading between the first housing part and the second housing part;

a first insulator body rotatably engaged with a second insulator body, the first and second insulator bodies respectively sealingly engageable with an interior surface of the first housing part and the second housing part;

electrical contact pins formed into the first insulator body and the second insulator body, the electrical contact pins each terminating in a separate electrical contact wherein the first insulator body rotatably engages the second insulator body; and a biased electrical contact disposed between each one of the separate electrical contacts of the first insulator body and a respective one of the separate electrical contacts in the second insulator body.

2. The connector of claim 1 wherein the electrical contacts in the second insulator body comprise contact rings covering substantially an entire circumference of the second insulator body.

3. The connector of claim 1 wherein the biased electrical contacts comprise a resilient, electrically conductive material.

4. The connector of claim 3 wherein the resilient, electrically conductive material comprises at least one of phosphor-bronze and spring steel.

5. The connector of claim 1, further comprising a tortuous path in the first insulator body and the second insulator body between the electrical contacts.

6. The connector of claim 1 wherein the biased electrical contacts comprise canted springs.

7. The connector of claim 1 wherein the first insulator body and the second insulator body comprise at least one of poly ether ketone and poly ether ether ketone.

8. The connector of claim 1 wherein the electrical contacts in at least one of the first and second insulator bodies are molded therein during formation of the at least one of the first and second insulator bodies.

9. The connector of claim 1, wherein at least the first insulator body or second insulator body comprises a plurality of assembles segments.

10. The connector of claim 1 wherein the electrical contacts in at least one of the first and second insulator bodies extend longitudinally beyond a longitudinal end of the at least one of the first and second insulator bodies to enable electrical contact with an adjacent instrument.

11. The connector of claim 1 wherein the first insulator body and the second insulator body are axially held in connection by a snap ring.

12. The connector of claim 1 wherein each of the first and the second insulator bodies comprises a thrust washer at a longitudinal end thereof.

13. The connector of claim 1 wherein the first housing part and the second housing part are coupled between a cable head attached to an armored electrical cable and at least one well logging instrument.

14. The connector of claim 1 further comprising a load bearing stem coupled to the first housing part and rotatably supported in the first housing part, the load bearing stem axially supported in the first housing part and engaged with the first insulator body to rotate therewith.

15. The connector of claim 14 wherein the load bearing stem is rotatably sealingly engaged to an interior of the first housing part.

16. The connector of claim 1 wherein the first and second insulator bodies define a sealed chamber inside the first housing part, the sealed chamber filled with a dielectric liquid.

17. The connector of claim 16 wherein the sealed chamber comprises a pressure compensator to communicate fluid pressure outside the sealed chamber to inside the sealed chamber.

18. The connector of claim 17, further comprising a flow control device for providing selective fluid communication between the sealed chamber and external environment.

19. The method of claim 16 wherein the electrical contacts in the second insulator body comprise contact rings covering substantially an entire circumference of the second insulator body.

20. A method for well logging, comprising:

moving at least one well logging instrument along an interior of a wellbore by extending or retracting an electrical cable; and relieving torque caused by extending or retracting the cable by enabling rotation of a swivel disposed between the at least one well logging instrument and at least one of a cable head connected to an end of the electrical cable and another well logging instrument, the swivel comprising:

a first housing part and a second housing part rotatably connected to each other, the connection enabling transfer of axial loading between the first housing part and the second housing part, a first insulator body rotatably engaged with a second insulator body, the first and second insulator bodies respectively sealingly engageable with an interior surface of the first housing part and the second housing part, electrical contact pins formed into the first insulator body and the second insulator body, the electrical contact pins each terminating in a separate electrical contact wherein the first insulator body rotatably engages the second insulator body, and a biased electrical contact disposed between each one of the separate electrical contacts of the first insulator body and a respective one of the separate electrical contacts in the second insulator body.

* * * * *